US009534348B2

(12) United States Patent
Rio et al.

(10) Patent No.: US 9,534,348 B2
(45) Date of Patent: Jan. 3, 2017

(54) PAVER TRANSITION MARK REDUCTION

(71) Applicant: Caterpillar Paving Products Inc., Brooklyn Park, MN (US)

(72) Inventors: Federico Rio, Pembroke Pines, FL (US); Ricky Leon Mings, Andover, MN (US)

(73) Assignee: Caterpillar Paving Products Inc., Brooklyn Park, MN (US)

( * ) Notice: Subject to any disclaimer, the term of this patent is extended or adjusted under 35 U.S.C. 154(b) by 27 days.

(21) Appl. No.: 14/623,375

(22) Filed: Feb. 16, 2015

(65) Prior Publication Data

US 2016/0237629 A1 Aug. 18, 2016

(51) Int. Cl.

| | |
|---|---|
| ***E01C 19/00*** | (2006.01) |
| ***E01C 19/46*** | (2006.01) |
| ***E01C 19/42*** | (2006.01) |
| ***E01C 23/02*** | (2006.01) |
| ***E01C 19/22*** | (2006.01) |

(52) U.S. Cl.

CPC ..... *E01C 19/46* (2013.01); *E01C 19/22* (2013.01); *E01C 19/42* (2013.01); *E01C 23/02* (2013.01); *E01C 2201/16* (2013.01); *E01C 2301/00* (2013.01)

(58) Field of Classification Search

CPC ..... E01C 19/22; E01C 19/42; E01C 19/46; E01C 23/02; E01C 2201/16; E01C 2301/00

USPC ..... 404/101, 102, 104, 118, 75, 84.05–84.8

See application file for complete search history.

(56) References Cited

U.S. PATENT DOCUMENTS 5,362,176 A * 11/1994 Sovik ..... E01C 19/006 404/72
5,546,123 A * 8/1996 Ikeda ..... E01C 19/006 348/119
5,924,819 A * 7/1999 Breidenbach ..... E01C 19/42 404/104
6,113,309 A * 9/2000 Hollon ..... E01C 19/006 180/20
6,270,284 B1 * 8/2001 Sovik ..... E01C 19/48 404/47
6,273,636 B1 * 8/2001 Johanpeter ..... E01C 19/4893 404/104
6,283,672 B1 * 9/2001 Sovik ..... E01C 19/48 404/118
6,352,386 B2 3/2002 Heims
6,435,766 B1 * 8/2002 Titford ..... B62D 49/0678 172/554

(Continued)

*Primary Examiner* — Raymond W Addie

(74) *Attorney, Agent, or Firm* — Miller, Matthias & Hull LLP

(57) ABSTRACT

A paving machine for reducing transition marks in a mat. The paving machine may comprise a frame, a tow arm, a screed assembly, a sensor and a controller. The screed assembly includes a main screed plate and an extension plate. The main screed plate is configured to pave a first surface section of the mat. The extension plate includes an extension trailing edge having an inner end. The extension plate is configured to pave a second surface section of the mat. The sensor is configured to sense transition marks in the mat proximal to an intersection between the first and second surface sections and to transmit data indicative of such to the controller. The controller may be configured to determine from the data received from the sensor when the inner end is disposed above or below the first plane, and move the inner end to the first plane.

20 Claims, 13 Drawing Sheets

(56) References Cited

U.S. PATENT DOCUMENTS

| | | | | |
|---|---|---|---|---|
| 7,491,014 | B2 * | 2/2009 | Sick | E01C 19/004 404/133.05 |
| 8,128,314 | B2 | 3/2012 | Buschmann | |
| 8,221,025 | B2 | 7/2012 | Buschmann | |
| 8,591,142 | B2 * | 11/2013 | Mittleman | E01C 19/48 404/96 |
| 2014/0186115 | A1 | 7/2014 | Graham et al. | |

* cited by examiner

Point in Time =T1

Point in Time =T2

PAVER TRANSITION MARK REDUCTION

TECHNICAL FIELD

The present disclosure generally relates to automatic control processes in machines and, more particularly, relates to automatic control processes for use on paving machines to reduce transition marks in the paved mat.

BACKGROUND

Paving machines are used to apply, spread and compact a mat of material relatively evenly over a desired base. These machines are regularly used in the construction of roads, parking lots and other areas where a smooth durable surface is required for cars, trucks and other vehicles to travel. A paving machine generally includes a hopper for receiving paving material from a truck and a conveyor system for transferring the paving material rearwardly from the hopper for discharge onto a roadbed base. Screw augers may be used to spread the paving material transversely across the base in front of a screed assembly. The screed assembly smoothes and somewhat compacts the paving material and, ideally, leaves a mat of uniform depth and smoothness.

The screed assembly is drawn behind the paving machine by a pair of pivotally mounted tow arms. The screed assembly includes a main screed and one or more screed extensions disposed behind (or, in some embodiments, in front of) and adjacent to the main screed. The extension(s) are slidable transversely to the direction of travel of the paving machine and allow varying widths of paving material to be laid.

Road mat thickness is determined, in part, by the position of the tow arms and the angle of attack of the screed assembly relative to the base. To pave an even surface, the trailing edge of the main screed, and at least the inner end of the trailing edge of the screed extension should remain in the same plane. A change in the vertical height of the tow arms may cause the trailing edge of the main screed to be disposed at a different elevation than the trailing edge of the screed extension, at least temporarily. This difference in elevation can cause inconsistencies or discontinuities in the paved mat.

U.S. Pat. No. 6,352,386 ("Heims") issued Mar. 5, 2002 describes a road finisher having a chassis and a floating laying beam that includes a basic beam and an extendable beam. The laying beam is attached to the chassis by tie bars. Each tie bar is pivotally articulated on its front end on the chassis. The point of articulation is adjustable in height with respect to the chassis.

Heims discloses height adjusting devices that keep the respective rear edges of the basic beam and of the extendable beam in the same plane. According to Heims, a pair of sensors is mounted on the tow arm. The sensors are offset from one another in the direction in which the mat is being laid. The sensor offset is the same as the offset distance between the basic beam and the extendable beam. In addition, the sensors are arranged at such a height above the reference plane, the underlying carriageway, that they measure the same vertical distance from the reference plane when the surfaces of the basic beam and of the extendable beam run parallel with respect to the reference plane. According to the disclosure, with any desired setting angle alpha, the difference in height between the sensors mounted on the tow arms corresponds to a height difference X between the extendable beam and the basic beam and is used to derive a height correction for the extendable beam. While such an arrangement may be beneficial, precise alignment and calibration is needed. Inaccurate readings may occur due to close proximity of the sensors to vibrating or rotating parts, inaccurate calibration during machine set up, and positional movement of the sensors or of the basic beam and extendable beams caused by normal wear and tear over time at paving work sites. A better design is needed.

SUMMARY OF THE DISCLOSURE

In accordance with one aspect of the disclosure, a paving machine for paving a mat on a base is disclosed. The mat having a first surface section contained in a first plane and a second surface section contained in a second plane, the second surface section adjacent to the first surface section. The paving machine comprising a frame, a tow arm connected to the frame and pivotable about a pivot point, a screed assembly connected to the frame by the tow arm, a sensor mounted on the screed assembly, and a controller. The screed assembly includes a main screed plate and an extension plate. The main screed plate is configured to pave the first surface section of the mat. The extension plate includes an extension trailing edge having an inner end. The extension plate is configured to pave the second surface section of the mat. The sensor is configured to sense transition marks in the mat proximal to an intersection between the first and second surface sections and is further configured to transmit data indicative of the transition marks to the controller. The controller may be configured to, while the paving machine is paving, determine from the data received from the sensor when the inner end is disposed above or below the first plane, and move the inner end to the first plane.

In accordance with another aspect of the disclosure, a method of automatically reducing transition marks made by a screed assembly of a paving machine in a mat while paving the mat over a base. The mat having a first surface section contained in a first plane and a second surface section contained in a second plane. The second surface section is adjacent to the first surface section. The paving machine includes a frame, a tow arm connected to the frame and pivotable about a pivot point, the screed assembly connected to the frame by the tow arm, a sensor mounted on the screed assembly, and a controller. The screed assembly includes a main screed plate and an extension plate. The main screed plate is configured to pave the first surface section of the mat. The extension plate includes an extension trailing edge having an inner end. The extension plate is configured to pave the second surface section of the mat. The sensor is configured to sense transition marks in the mat proximal to an intersection between the first and second surface sections and to transmit data indicative of the transition marks to the controller. The method comprising, while paving, determining, by the controller based on data received from the sensor, when the inner end is disposed above or below the first plane, and moving, by the controller based on the determining, the inner end to the first plane.

In accordance with a further aspect of the disclosure, a paving machine for paving a mat on a base is disclosed. The mat having a first surface section contained in a first plane and a second surface section contained in a second plane, the second surface section adjacent to the first surface section. The paving machine may comprise a frame, a tow arm connected to the frame and pivotable about a pivot point, a screed assembly connected to the frame by the tow arm, a plurality of sensors mounted on the screed assembly, a frame inclinometer mounted on the frame and configured to measure a frame slope in relation to a horizontal plane at a first point in time and a second point in time, a screed inclinometer mounted on the screed assembly and configured to measure a screed slope of the main screed plate in relation to the horizontal plane at the first point in time and the second point in time, and a controller. The screed assembly includes a main screed plate and an extension plate. The main screed plate is configured to pave the first surface section of the mat. The extension plate includes an extension trailing edge having an initial inner end. The extension plate is configured to pave the second surface section of the mat. The plurality of sensors are configured to sense transition marks in the mat proximal to an intersection between the first and second surface sections and are further configured to transmit data indicative of the transition marks to the controller. The controller configured to, while the paving machine is paving, calculate a frame slope change and a screed slope change, determine whether the frame slope change is different than the screed slope change, when the first plane and the second plane are parallel and the frame slope change is different than the screed slope change, move the extension trailing edge to the first plane, and when the second plane is disposed at an angle to the first plane and the frame slope change is different than the screed slope change, move the initial inner end to the first plane.

BRIEF DESCRIPTION OF THE DRAWINGS

FIG. 2 is a perspective view of the screed assembly of FIG. 1 including a main screed including a main screed plate and a screed extension including an extension plate, for clarity the screed assembly is shown without the operator step, gates, handle, side plates, and the like;

DETAILED DESCRIPTION

Figure 1:
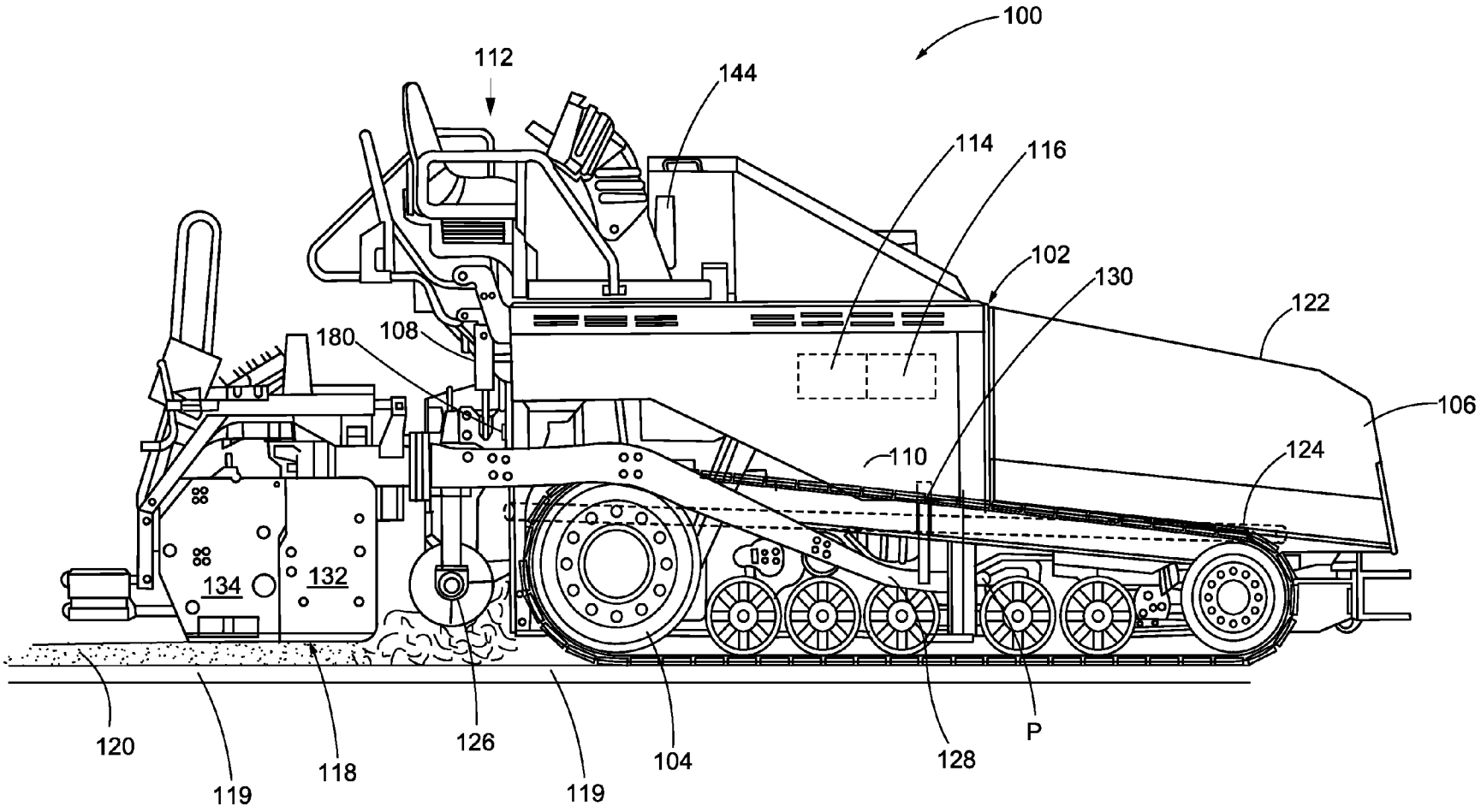
FIG. 1 is a diagrammatic side view of an exemplary paving machine having tow arms that tow an exemplary screed assembly.

FIG. 1 illustrates one example of a paving machine 100 that incorporates the features of the present disclosure. The paving machine 100 paves a mat 120 on a base 119. The paving machine 100 includes a frame 102 coupled to a set of ground-engaging elements 104, such as wheels or tracks, coupled to the frame 102. The frame 102 has a front 106, a rear 108 and includes a plurality of sides 110. An operator station 112 may be mounted to the frame 102. In one embodiment, the operator station 112 may be mounted to the frame 102 proximal to the rear 108 of the frame 102. One of ordinary skill in the art will appreciate that an engine 114 may provide power to the ground-engaging elements 104 and a final drive assembly (not shown) via mechanical or electric drive drain. The engine 114 may further drive an associated generator 116 that can be used to power various systems on the paving machine 100. A screed assembly 118 may be attached at the rear 108 of the frame 102 to spread and compact paving material into a layer or mat 120 of desired thickness, size and uniformity on the base 119.

The paving machine 100 may further include a hopper 122 adapted for storing a paving material, and a conveyor system including one or more conveyors 124 configured to move paving material from the hopper 122 to the screed assembly 118 at the rear 108 of the frame 102. The conveyors 124 may be arranged at the bottom of the hopper 122 and, if more than one is provided, may be positioned side-by-side and run parallel to one another back to the rear 108 of the frame 102. While an endless path conveyor 124 is shown, one or more feed augers or other material feed components may be used instead of or in addition to the conveyor 124.

One or more augers 126 may be arranged near the rear 108 of the frame 102 to receive the paving material supplied by the conveyor 124 and spread the material evenly beneath the screed assembly 118. Although only one auger 126 is shown in FIG. 1, the paving machine 100 may have a single auger or any number of augers.

The screed assembly 118 is connected to the frame 102 by a pair of tow arms 128 (only one of which is visible in FIG. 1) that extend between the frame 102 and the screed assembly 118. The tow arms 128 are connected to the frame 102 and are pivotable about a pivot point P. Tow arm actuators 130 are operably connected to the tow arms 128 and the frame 102. The tow arm actuators 130 are configured to raise and lower the tow arms 128 at pivot point P (in a direction perpendicular to the base 119 to be paved) and thereby raise and lower the screed assembly 118. The tow arm actuators 130 may be any suitable actuators, such as, for example, hydraulic cylinders.

Changing the position of the tow arms 128 at pivot point P relative to the base 119 to be paved changes the thickness of the resulting paved mat 120 and also, temporarily, changes the angle of attack of the screed assembly 118 relative to the base 119 being paved. This change in angle of attack is due to the natural pivot movement of the tow arms 128 about the pivot point P when the pivot point P is raised or lowered. While such change to the angle of attack also effects the thickness of the paved mat 120, the change is typically temporary. Because the screed assembly 118 "floats" on the paving material, the screed assembly 118 eventually "floats" to the higher or lower elevation set by the new position of the tow arms 128 and returns to the original angle of attack set for the screed assembly 118.

Figure 2:
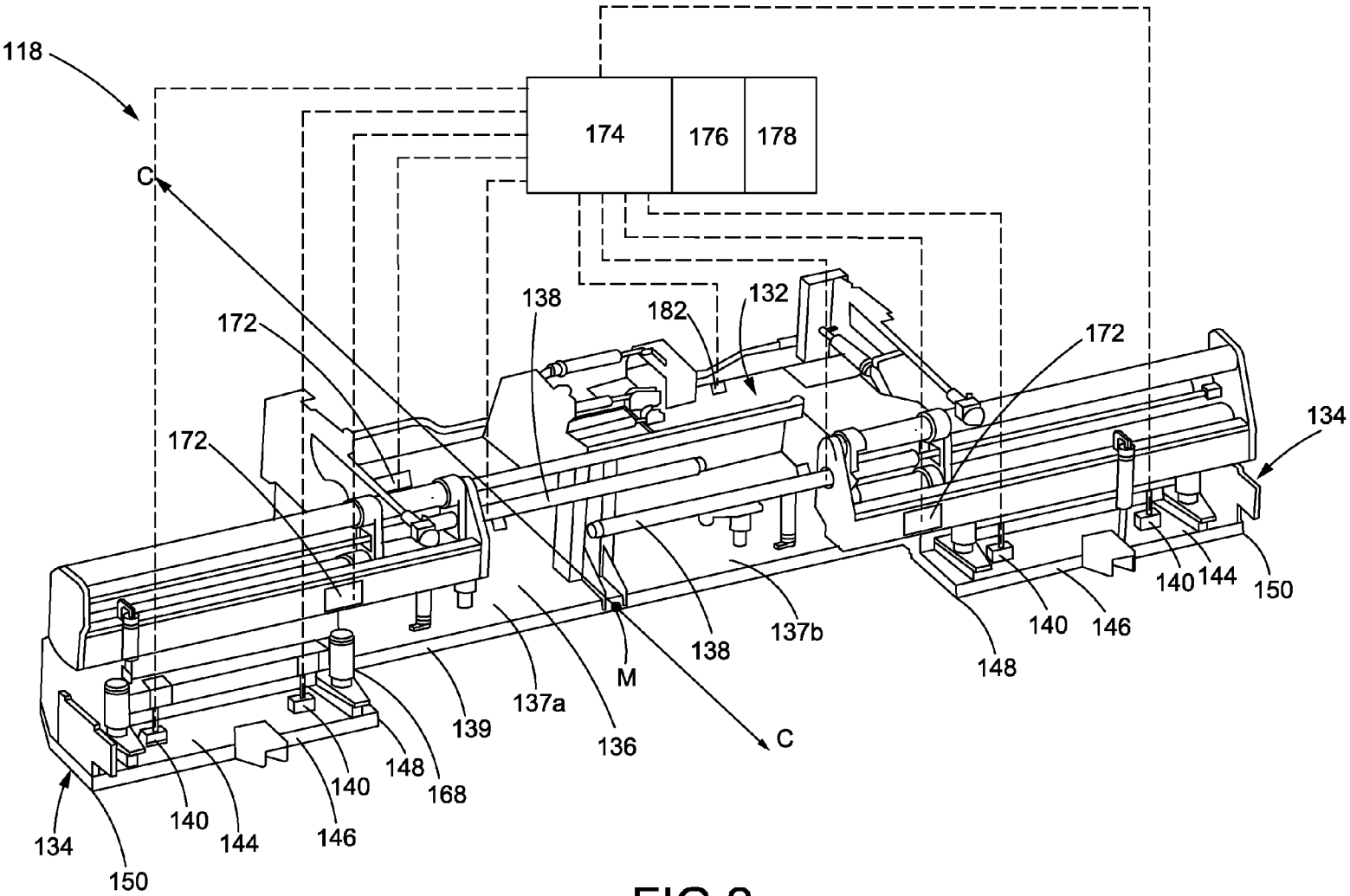
Figure 3:
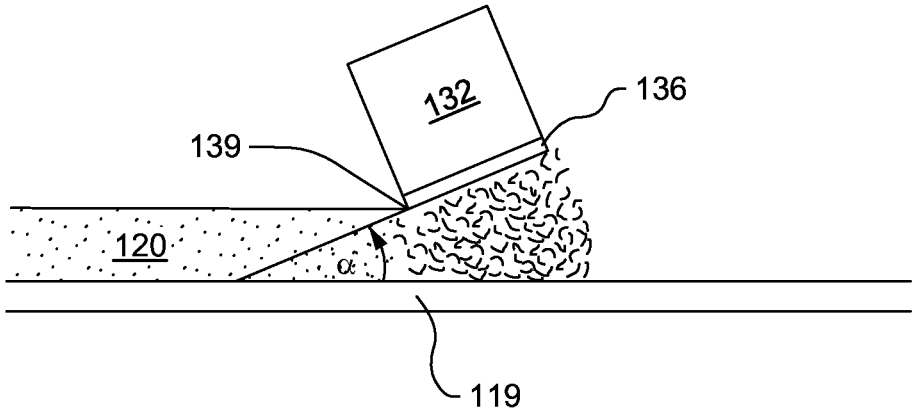
FIG. 3 is a schematic representation of the angle of attack of the main screed plate.

FIG. 2 illustrates an exemplary screed assembly 118 that includes a main screed 132 and one or more screed extensions 134. The main screed 132 may include a main screed plate 136. In operation, the main screed plate 136 will smooth and compress paving material as the screed assembly 118 (and the main screed 132) is floatingly pulled by the paving machine 100 (and tow arms 128) over the paving material. The main screed plate 136 may be comprised of a single plate or a plurality of connected plate sections. Such connected plate sections may, in some embodiments, be disposed at an angle to each other (or moveable to such an angle) in order to provide a crowned paved surface, as is known in the art. For example, in the exemplary screed assembly 118 shown in FIG. 2, the main screed plate 136 includes right and left plate sections 137*a*, 137*b* connected to one another along a centerline C that extends (in the direction of paving machine 100 travel) through the midpoint M of the main screed plate 136. The right and left plate sections 137*a*, 137*b* are connected to one another so as to be capable of being disposed at an angle relative to each other in order to provide a crowned paved surface. The main screed plate 136 includes a main screed trailing edge 139. The main screed trailing edge 139 has an inside end 168 disposed adjacent to the extension plate 144. As shown in FIG. 3, the main screed plate 136 may be oriented at a slope or an angle $\alpha$ to the base 119 such that the main screed trailing edge 139 defines the surface of the mat 120 paved by the main screed plate 136. Such an angle $\alpha$ may be referred to as the angle of attack.

As shown in FIG. 2, screed extension(s) 134 may be provided behind and adjacent to the main screed 132, although, in other embodiments, the screed extension(s) 134 may, alternatively, be positioned in front of the main screed 132. In the embodiment shown in FIG. 2, there are two screed extensions 134, one disposed on either side of the main screed 132. The screed extensions 134 are slidably movable, in a parallel direction relative to the main screed 132, between retracted and extended positions so that varying widths of paving material can be laid. This slidable movement is transverse to the direction of travel of the paving machine 100. The parallel movement of the screed extensions 134 relative to the main screed 132 may be driven by respective powered screed width actuators 138, such as hydraulic or electric actuators. Each screed extension 134 includes an extension plate 144.

In addition to being movable relative to the main screed 132, each screed extension 134 may also be configured such that the height of the screed extension 134 (and its extension plate 144) can be adjusted relative to the base 119 during paving. As shown in FIG. 2, the height of the screed extensions 134 may be adjusted by powered height actuators 140, such as hydraulic or electric actuators.

Figure 4:
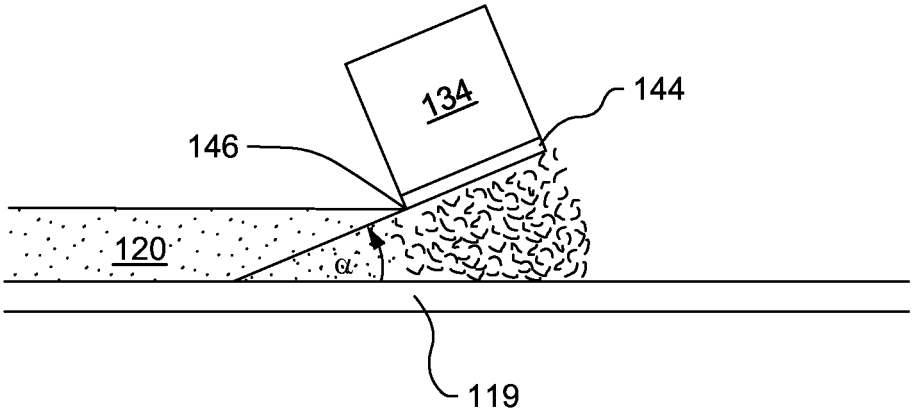
FIG. 4 is a schematic representation of the angle of attack of the extension plate.

The extension plate 144 includes an extension trailing edge 146. The extension trailing edge 146 is the lower edge of the extension plate 144 that is in contact with the paved mat 120 (see FIG. 4). As shown in FIG. 2, the extension trailing edge 146 has an inner end 148 and an outer end 150. The inner end 148 is proximal to a centerline C extending in the direction of travel through the midpoint M of the main screed plate 136, whereas the outer end 150 is distal to the centerline C. The midpoint M is disposed at a point half of the distance across the main screed plate 136 in a direction that is transverse to the direction of travel of the paving machine 100. As shown in FIG. 4, the extension plate 144 may be oriented at the angle $\alpha$ (angle of attack) to the base 119 to be paved. In some embodiments, the entire extension trailing edge 146 and the main screed trailing edge 139 may be in the same plane, whereas in other embodiments, only a portion of the extension trailing edge 146 and the main screed trailing edge 139 may be in the same plane, namely the part of the extension trailing edge 146 that intersects the plane that contains the main screed trailing edge 139.

Figure 5A:
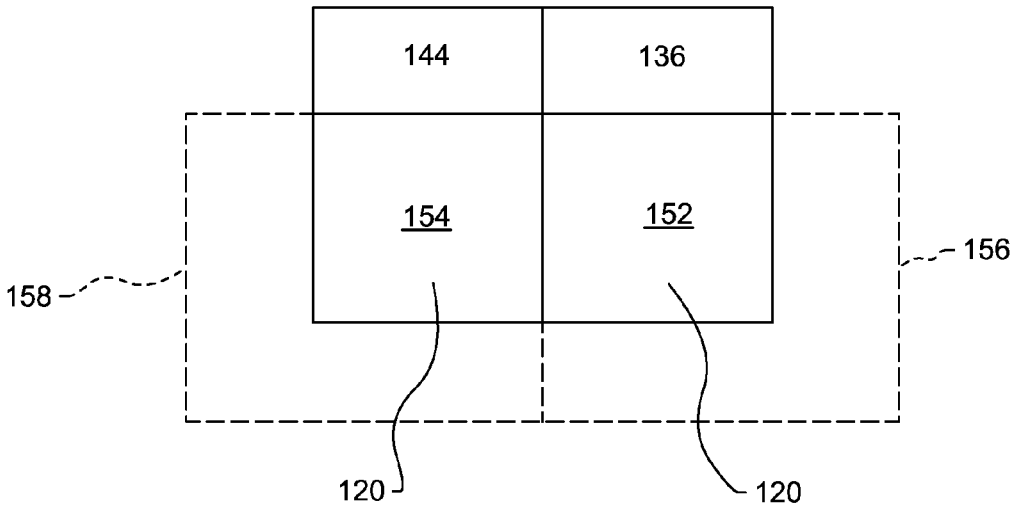
FIGS. 5A-5C are schematic representations of embodiments illustrating the parallel orientation of a first surface section and a second surface section of the mat.

As best illustrated in FIG. 5A, the mat 120 has a first surface section 152 and a second surface section 154. The main screed 132 (FIG. 2) is configured to pave the first surface section 152 (FIG. 5A) of the mat 120. More specifically, the first surface section 152 is paved by the main screed plate 136 and is disposed behind the main screed plate 136. Such first surface section 152 is contained in a first plane 156. The screed extension 134 (FIG. 2), including the extension plate 144, is configured to pave the second surface section 154 (FIG. 5A). The second surface section 154 is disposed behind the extension plate 144. Such second surface section 154 is contained in a second plane 158 and is adjacent to the first surface section 152.

Figure 5B:
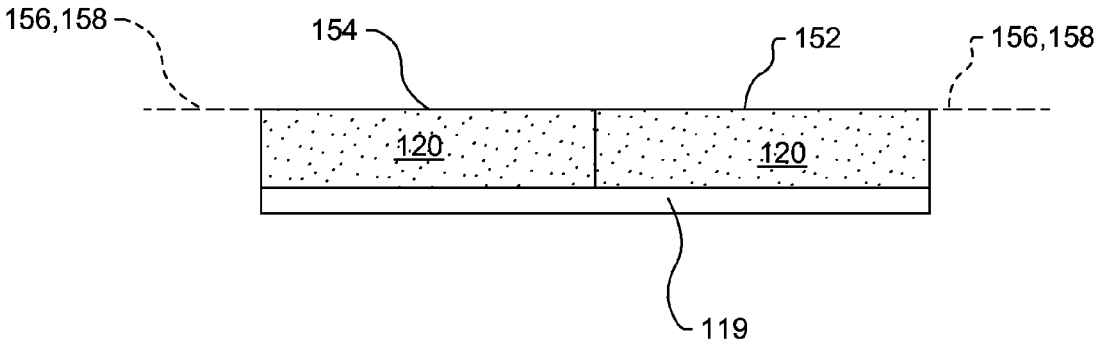
Figure 5C:
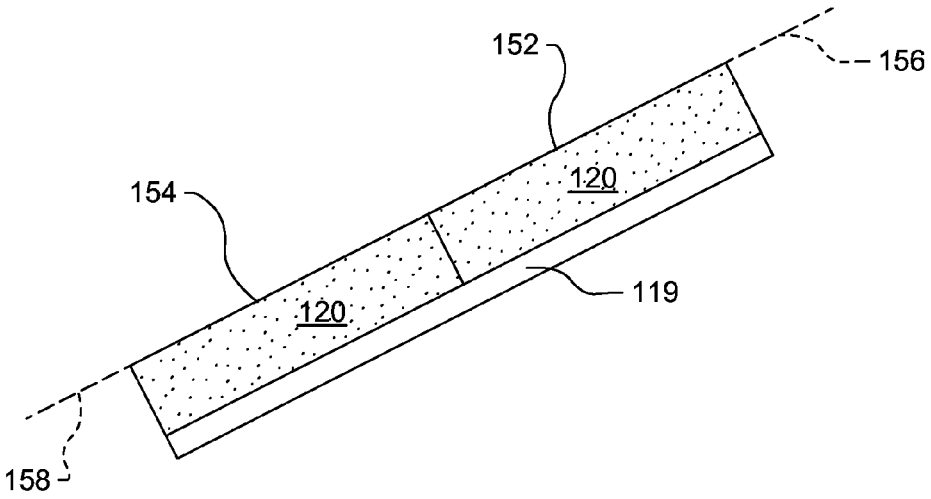

In some embodiments, the first plane 156 and the second plane 158 may be the same plane. FIGS. 5A-5C schematically illustrate exemplary embodiments where the first plane 156 and second plane 158 are the same plane because the first and second surface sections 152, 154 of the mat 120 lie in the same plane. In FIGS. 5A-B, the first and second surface sections 152, 154 are substantially horizontal. In FIG. 5C, the first and second surface sections 152, 154 are both disposed in the same sloping plane.

Figure 6:
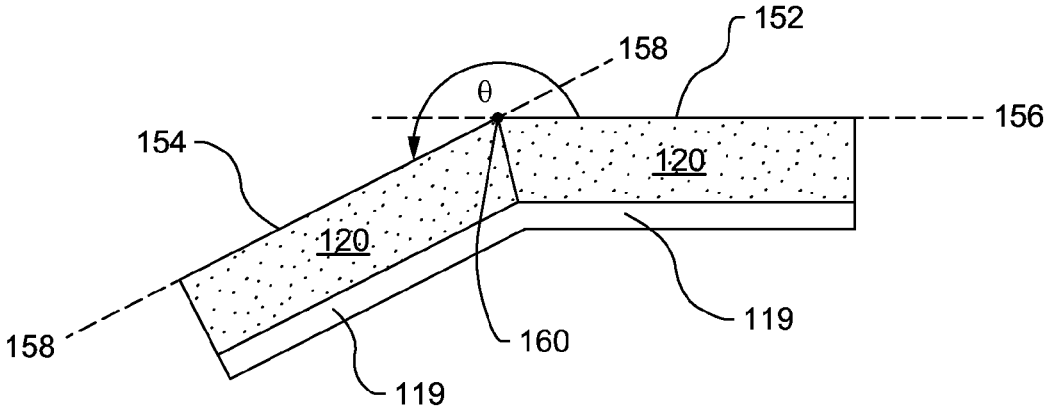
FIG. 6 is a schematic representation of an embodiment illustrating the first and second surface sections of the mat oriented at an angle to each other.

In other embodiments, the first and second surface sections 152, 154 of the mat 120, and their respective first and second planes 156, 158 may be oriented at an angle $\theta$ to each other (as measured from the first surface section 152 to the second surface section 154). For example, in FIG. 6, the second surface section 154 (and the second plane 158) is oriented at an angle $\theta$ to the first surface section 152 (and the first plane 156), and the second plane 158 (and second surface section 154) intersects the first plane 156 (and first surface section 152) at intersection 160. In this exemplary embodiment, angle $\theta$ is a reflex angle.

During paving, transition marks 162 (see FIGS. 7A-8B, 9B-11), for example transition ridges 164 or transition wavers 166, may occur in the mat 120. Transition ridges 164 are steps or disconnects in the surface of the mat 120 due to changes in the elevation of adjacent surface sections. Such transition ridges 164 extend in the direction of paving machine 100 travel. Transition wavers 166 are transverse shifts in the position of the intersection 160 of adjacent surface sections that are oriented at an angle to each other. One result is that the width of the planar portion of the mat 120 and the sloped portion of the mat 120 tends to vary.

Transition marks 162 may happen in a number of ways. For example, if the main screed trailing edge 139 (FIGS. 7A-8B) and the extension trailing edge 146 are configured to be offset (in the direction of paving machine 100 travel), yet disposed in (and pave in) the same plane, transition ridges 164 occur when the tow arms 128 (FIG. 1) are adjusted up or down at (or adjacent to) the pivot point P.

When the height of the tow arms 128 at pivot point P is adjusted up to increase the thickness of the mat 120, the screed assembly 118 will initially pivot somewhat about pivot point P thereby temporarily increasing the angle of attack of both the main screed plate 136 and the extension plate 144. The plate that is further away from the pivot point P will dig downward to a greater depth relative to the other plate. For example, in FIG. 2, the extension plate 144 is disposed behind the main screed plate 136, so the extension plate 144 will move to a lower depth than the main screed plate 136.

Figure 7A:
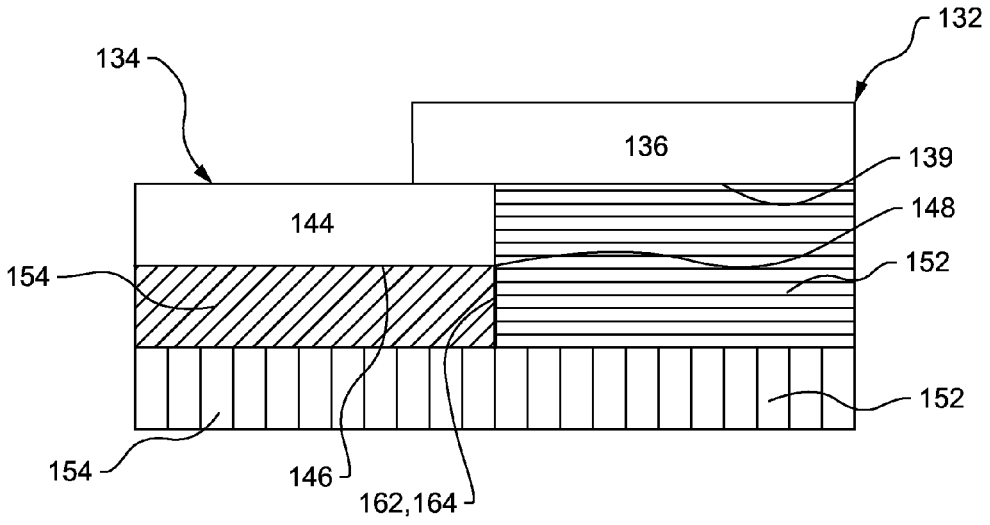
FIGS. 7A-7B are schematic representations illustrating parallel first and second surface sections of the (paved) mat and an exemplary transition ridge between them.

FIG. 7A illustrates this scenario. The main screed trailing edge 139 and the extension trailing edge 146 are offset and configured to pave in the same plane. The screed extension 134 is not fully extended and a portion of the extension trailing edge 146 overlaps the area paved by the main screed plate 136. The resulting first and second surface sections 152, 154 are initially contained in the same plane. When the tow arms 128 are raised, the extension trailing edge 146 will drop below the paving plane of the main screed trailing edge 139 and will pave a second surface section 154 of the mat 120 that has a lower depth than the portion of the first surface section 152 that is paved exclusively by the main screed plate 136 (and its main screed trailing edge 139). The difference in mat 120 hatching is intended to show the change in depth. A transition mark 162, in this case a transition ridge 164 (extending in the direction of paving machine 100 travel), will be created between the first surface section 152 paved by (and exclusively behind) the main screed plate 136 and the second surface section 154 paved by (and behind) the extension plate 144. In this example, the transition ridge 164 will form adjacent to the inner end 148 of the extension trailing edge 146 for as long as the extension trailing edge 146 remains in a lower paving plane than the plane of the surface paved exclusively by the main screed plate 136 (and its main screed trailing edge 139). As noted before, eventually both the main screed trailing edge 139 and the extension trailing edge 146 will float upward to the new mat 120 thickness, and the angle of attack of both the main screed plate 136 and the extension plate 144 will return to their previous value.

Figure 7B:
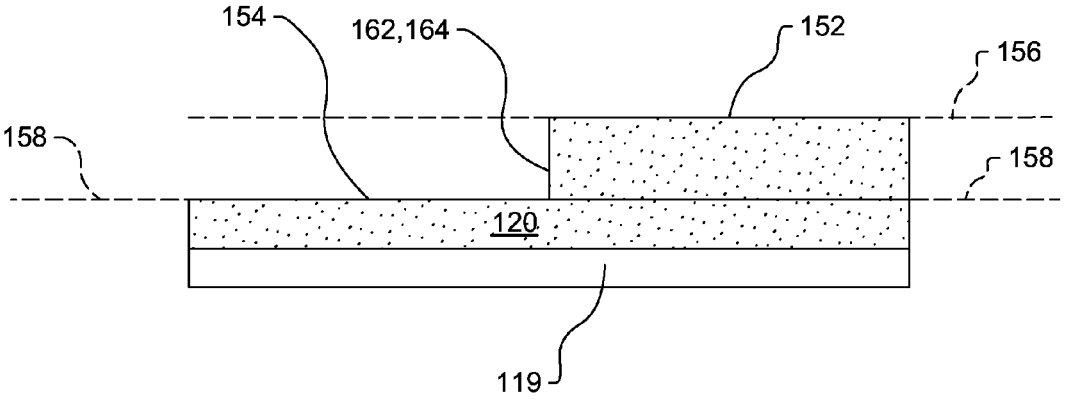

FIG. 7B schematically illustrates a cross section of the mat 120 and transition ridge 164 of FIG. 7A formed when the first and second surface sections 152, 154 are contained in different parallel planes (the first plane 156 is above the second plane 158). The transition ridge 164 extends upward from the lower second plane 158 toward the first plane 156.

If the height of the tow arms 128 (FIG. 1) is decreased at pivot point P to reduce the thickness of the paved mat 120, the screed assembly 118 will initially pivot about pivot point P thereby temporarily decreasing the angle of attack of both the main screed plate 136 and the extension plate 144. Whichever plate that is further away from the pivot point P will rise upward (away from the mat 120) to a greater degree than the other plate.

Figure 8A:
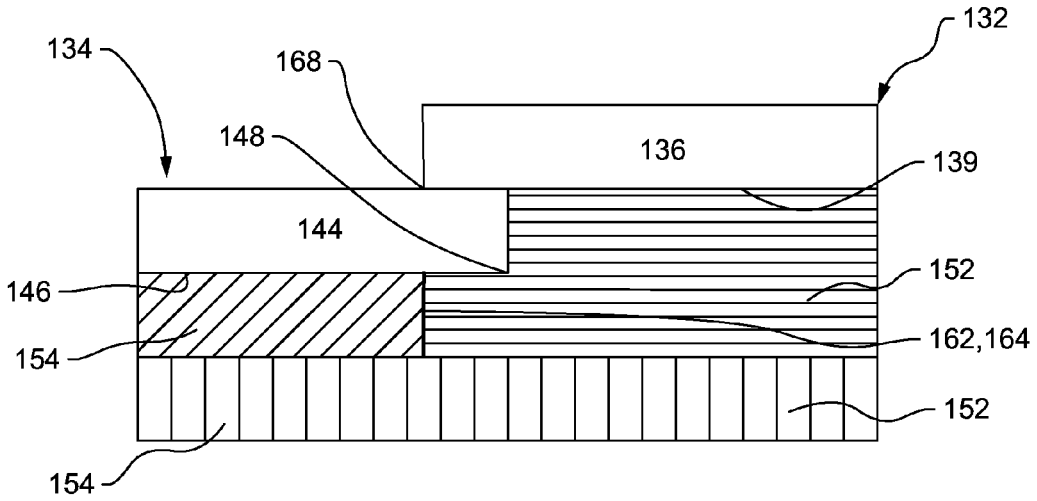
FIGS. 8A-8B are schematic representations illustrating parallel first and second surface sections of the mat and an exemplary transition ridge between them.

FIG. 8A illustrates this scenario. When the tow arms 128 are lowered, the extension trailing edge 146 will rise above the paving plane of the main screed trailing edge 139 and will pave a second surface section 154 of the mat 120 that is higher than the first surface section 152 behind the main screed plate 136. During this period, the inner end 148 of the extension trailing edge 146 will not be in contact with the portion of the mat 120 surface paved by the main screed plate 136. A transition ridge 164 will be created between the first surface section 152 behind (and paved by) the main screed plate 136 and the portion of the second surface section 154 exclusively behind (and paved by) the extension plate 144. In this scenario, the transition ridge 164 will form adjacent to the extension trailing edge 146 and proximal to the inside end 168 of the main screed trailing edge 139 for as long as the extension trailing edge 146 remains in a higher plane than the plane of the surface paved by the main screed plate 136. As noted before, eventually both the main screed trailing edge 139 and the extension trailing edge 146 will float downward to the new mat 120 thickness, and the angle of attack of both the main screed trailing edge 139 and the extension trailing edge 146 will return to its previous value.

Figure 8B:
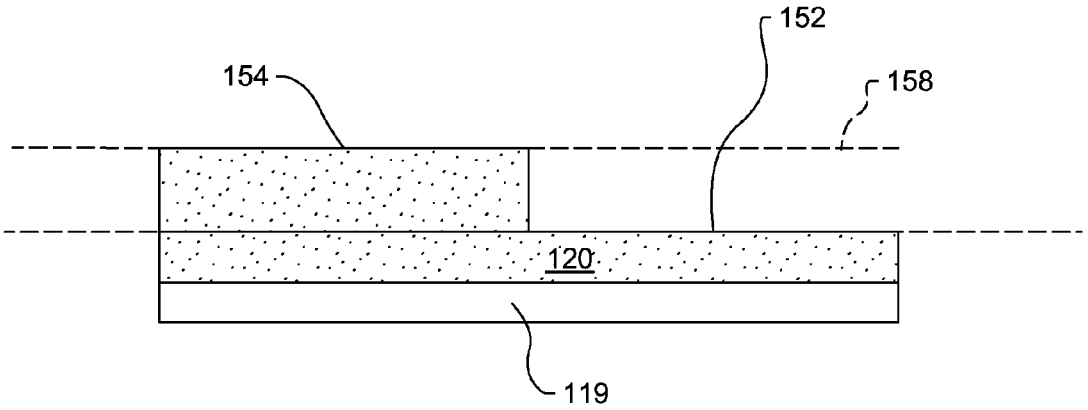

FIG. 8B schematically illustrates a cross section of the mat 120 and transition ridge 164 of FIG. 8A formed when the first and second surface sections 152, 154 are contained in different parallel planes (the first plane 156 is below the second plane 158). The transition ridge 164 extends upward from the lower first plane 156 toward the second plane 158.

Figure 9A:
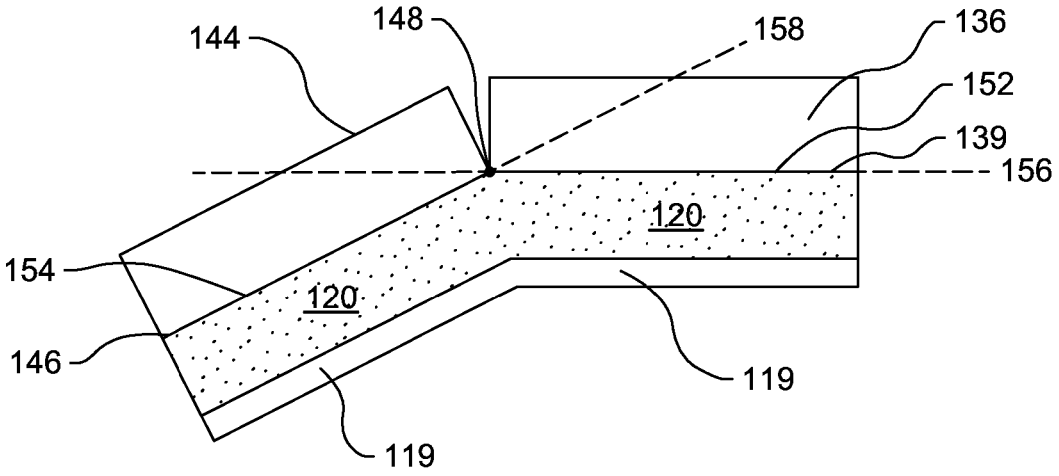
FIG. 9A is a schematic representation illustrating first and second surface sections of the mat oriented at an angle to each other prior to an increase or decrease in the tow arm height.

A transition ridge 164 can also happen if the screed extension 134 is disposed at an angle to the main screed 132. FIG. 9A illustrates an example when the screed extension 134 is disposed behind the main screed 132 and is fully extended and is disposed at an angle to the main screed 132. More specifically, FIG. 9 is a schematic representation of a cross sectional view of the mat 120, the main screed plate 136 and the extension plate 144. As shown in FIG. 9A, the inner end 148 of the extension trailing edge 146 is in the same paving plane (the first plane 156) as the first surface section 152 paved by the main screed plate 136.

Figure 9B:
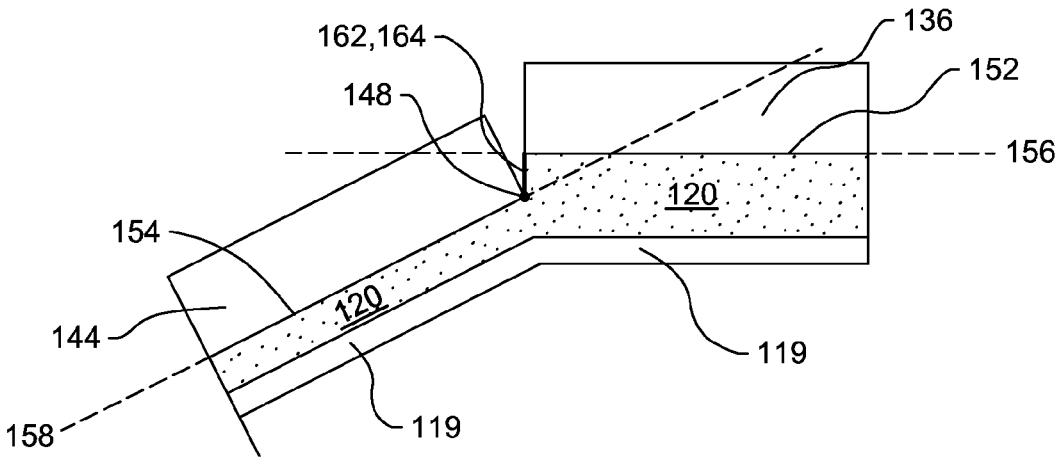
FIGS. 9B-9C are schematic representations illustrating the first and second surface sections of the (paved) mat and an exemplary transition ridge between the them.

When the tow arms 128 (FIG. 1) are raised, the angle of attack will increase more for the extension plate 144 than for the main screed plate 136. This will result in a transition ridge 164 (FIG. 9B) forming between the first surface section 152 paved by the main screed plate 136 and the second surface section 154 paved by the extension plate 144. As can be seen in FIG. 9B, the transition ridge 164 (or step) is formed when the inner end 148 of the extension trailing edge 146 drops below the first plane 156 that contains the first surface section 152. This will occur for as long as the inner end 148 of the extension trailing edge 146 remains below the first plane 156.

Figure 9C:
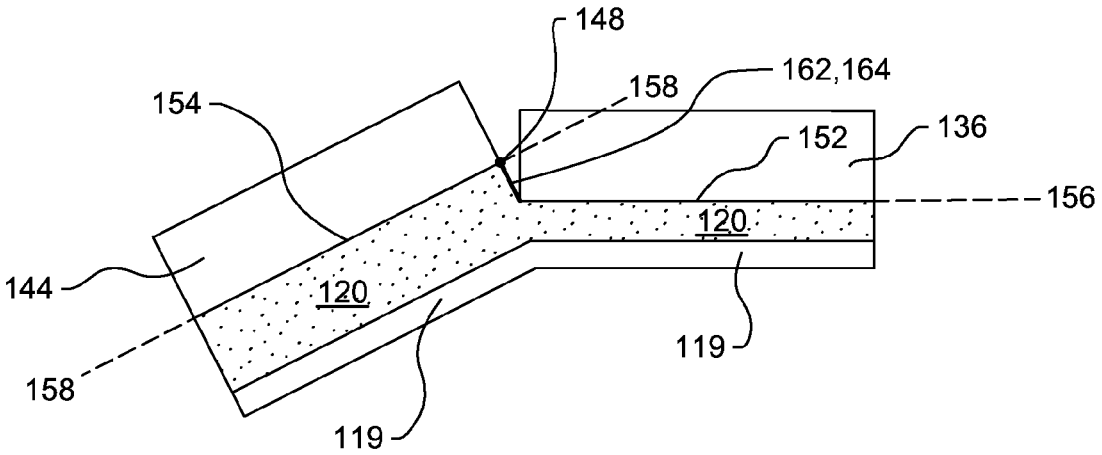

FIG. 9C illustrates the transition ridge 164 that occurs when the tow arms 128 are lowered. Namely, the angle of attack will decrease more for the extension plate 144 than the main screed plate 136. This will result in a transition ridge 164 between the surface paved by the main screed plate 136 and the surface paved by the extension plate 144 (as shown in FIG. 9C) for as long as the inner end 148 of the extension trailing edge 146 is disposed above the first plane 156 that contains the first surface section 152.

Figure 10:
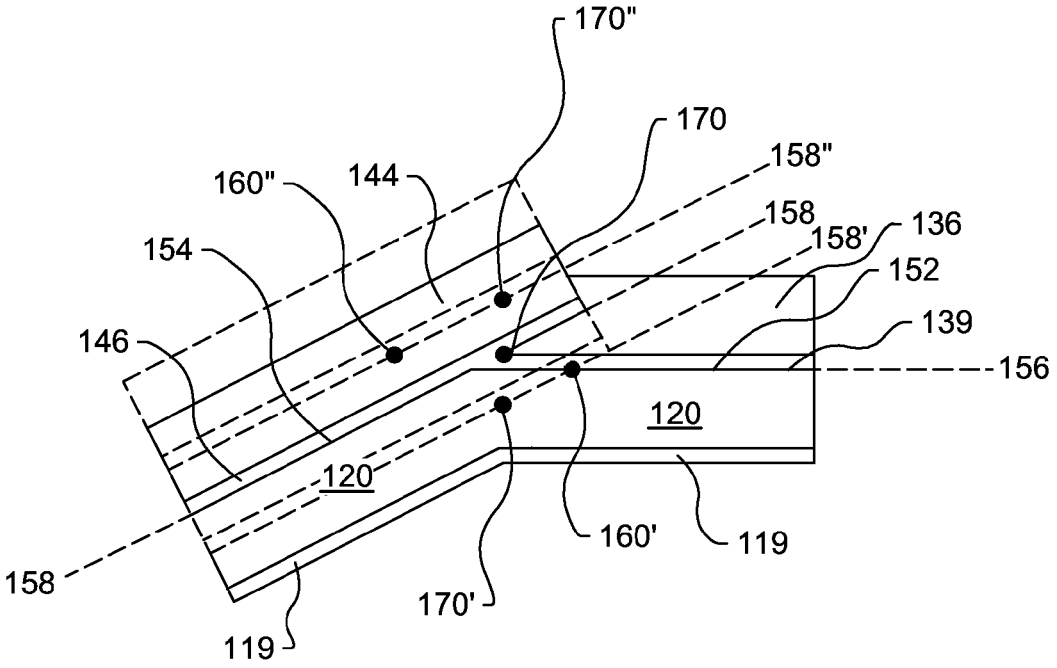
FIG. 10 is a schematic representation illustrating exemplary first and second surface sections of the (paved) mat and the position of an initial inner end of the extension trailing edge in relation to the first and second surface sections.

In some embodiments, the extension plate 144 may be oriented at an angle to the main screed plate 136 but the extension plate 144 may not be in a fully extended position. FIG. 10 schematically illustrates this scenario, where the physical end of the extension plate 144 may be disposed in the air above the main screed plate 136. In that scenario, the comparable inner end 148 (of the previous scenarios) of the extension trailing edge 146 may be referred to, instead, as the initial inner end 170. Such initial inner end 170 is disposed at a physical position along the transverse length of the extension trailing edge 146, as opposed to at the physical end of the extension trailing edge 146. This initial inner end 170 is established when the orientation and position of the extension plate 144 and the main screed plate 136 is selected by the operator. The initial inner end 170 is the innermost end of the extension trailing edge 146 that is in contact with the paving material. Such initial inner end 170 does not change when the height of the tow arms 128 is increased or decreased because it represents a reference point on the extension trailing edge 146 that is set when the operator configures the screed assembly 118 for the paving operation. When the tow arms 128 are raised or lowered, the intersection 160 of the first surface section 152 paved only by the main screed plate 136 and the second surface section 154 paved by the extension plate 144 may move transversely to the direction of travel, thus causing the initial inner end 170 to move below or above the first plane 156 that contains the first surface section 152.

Figure 11:
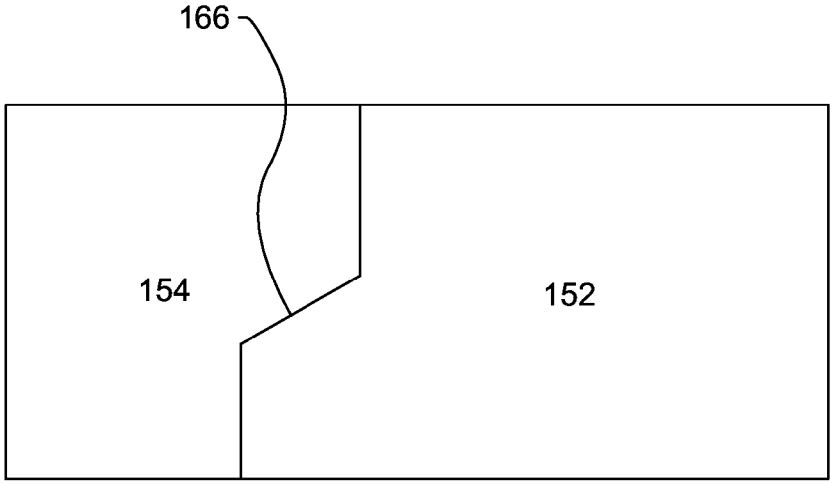
FIG. 11 is schematic representation illustrating the first and second surface sections of the (paved) mat and a transition waver between the them.

FIG. 10 illustrates an exemplary initial inner end 170, intersection 160 and second plane 158. FIG. 10 also illustrates the position of the exemplary initial inner end 170' and the resulting intersection 160' and second plane 158' right after the tow arms 128 are raised, and the position of the initial inner end 170," the resulting intersection 160" and second plane 158" right after the tow arms 128 are lowed. The transverse movement of the intersection 160 causes a transition mark 162 that may be referred to as a transition waver 166. FIG. 11 schematically illustrates one such example of a transition waver 166.

The paving machine 100 may further include one or more sensors 172 (see FIG. 2). The sensor(s) 172 may be mounted on the screed assembly 118. In one embodiment, the sensor(s) 172 may be mounted on the screed extension 134. In some embodiments, the sensor(s) 172 may be mounted on the main screed 132. The sensor(s) 172 may be any sensor known in the art to sense or detect changes in the surface characteristics of the mat 120, such as transition marks 162 like a transition ridge 164 or a transition waver 166, proximal to the intersection 160 between the first and second surface sections 152, 154. The sensor(s) 172 may be further configured to transmit data indicative of such changes/transition marks 162 to a controller 174. The sensor(s) 172 may be any laser sensor(s), sonic sensor(s) or any other appropriate sensor(s).

The paving machine 100 may also include a controller 174. The controller 174 may include a processor 176 (FIG. 2) and a memory component 178. The processor 176 may be a microprocessor or other processor as known in the art. The processor 176 may execute instructions and generate control signals for processing an input signal indicative of changes in the surface characteristics of the mat 120 proximal to the intersection 160 between the first and second surface sections 152, 154 such as transition marks 162 like a transition ridge 164 or a transition waver 166. Such instructions that are capable of being executed by a computer may be read into or embodied on a computer readable medium, such as the memory component 178 or provided external to the processor 176. In alternative embodiments, hard wired circuitry may be used in place of, or in combination with, software instructions to implement a control method.

The term "computer readable medium" as used herein refers to any non-transitory medium or combination of media that participates in providing instructions to the processor 176 for execution. Such a medium may comprise all computer readable media except for a transitory, propagating signal. Common forms of computer-readable media include, for example, a floppy disk, a flexible disk, hard disk, magnetic tape, or any other magnetic medium, a CD-ROM, any other optical medium, or any other medium from which a computer processor 176 can read.

The controller 174 is not limited to one processor 176 and memory component 178. The controller 174 may be several processors 176 and memory components 178.

The controller 174 is operably connected to the sensors 172. The tow arm actuators 130 (FIG. 1), screed width actuators 138 (FIG. 2) and height actuators 140 may be operably connected to the controller 174. The controller 174 is configured to determine based on data received from the sensors 172 while paving, when the inner end 148 is disposed above or below the first plane 156, and then move the inner end 148 to the first plane 156. The controller 174 may be further configured to maintain the inner end 148 in the first plane 156 as the paving machine 100 moves forward until the sensor(s) 172 do not sense additional transition marks 162. In screed assembly 118 arrangements in which the main screed plate 136 and the extension plate 144 are configured to be oriented at an angle to each other, the controller 174 may also be configured to determine an initial inner end 170. The controller 174 may be further configured to determine based on data received from the sensors 172 while paving, when the initial inner end 170 is disposed above or below the first plane 156, and then to move the initial inner end 170 to the first plane 156. The controller 174 may be further configured to maintain the initial inner end 170 in the first plane 156 as the paving machine 100 moves forward until the sensor(s) 172 does/do not sense additional transition marks 162. In some embodiments, the controller 174 may also be configured to change in a first direction a position of the tow arms 128 at the pivot point P (raise or lower the tow arms 128).

There are factors, other than an increase or decrease in the height of the tow arms 128, that may change the angle of attack of the main screed plate 136 relative to the base 119 being paved. For example, the operator may adjust the angle of attack of the main screed plate 136 and the extension plate 144, manually or electronically, or an external factor such as a change in the temperature or consistency of the paving material may cause the angle of attack to change.

Figure 14A:
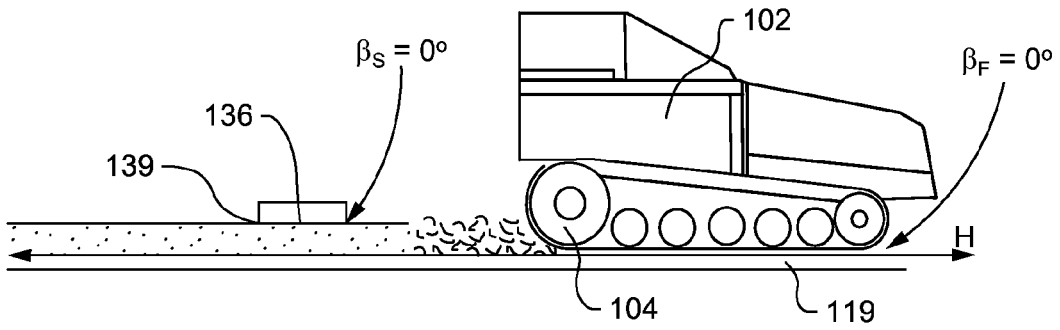
FIGS. 14A-B are schematic representations of the slope measurements of the frame of the paving machine and the main screed plate.

In another embodiment, the paving machine 100 may further include one or more frame inclinometers 180 (FIG. 1) mounted on the frame 102, and one or more screed inclinometers 182 (FIG. 2) mounted on the screed assembly 118. The frame inclinometer(s) 180 and the screed inclinometer(s) 182 are in communication with the controller 174. In one embodiment, the screed inclinometer(s) 182 may be mounted on the main screed 132. The frame inclinometer(s) 180 and the screed inclinometer(s) 182 may be any inclinometer, or the like, known in the art that measure angles of slope relative to a horizontal plane. The frame inclinometer(s) 180 are configured to measure the slope of the frame, or ground engaging elements, relative to a horizontal plane (the "frame slope" ($\beta_F$)). The screed inclinometer(s) 182 are configured to measure either the slope of the main screed plate 136 relative to a horizontal plane H or, alternatively, the slope of the main screed 132 relative to a horizontal plane (either one considered a "screed slope" ($\beta_S$)). For example, 14A is a schematic illustration of the frame slope $\beta_F$ relative to a horizontal plane H and the screed slope $\beta_S$ relative to a horizontal plane H at a first point in time T1. In FIG. 14A the screed slope $\beta_S$ is based on a measurement of the slope of the main screed plate 136 relative to a horizontal plane H.

Figure 14B:
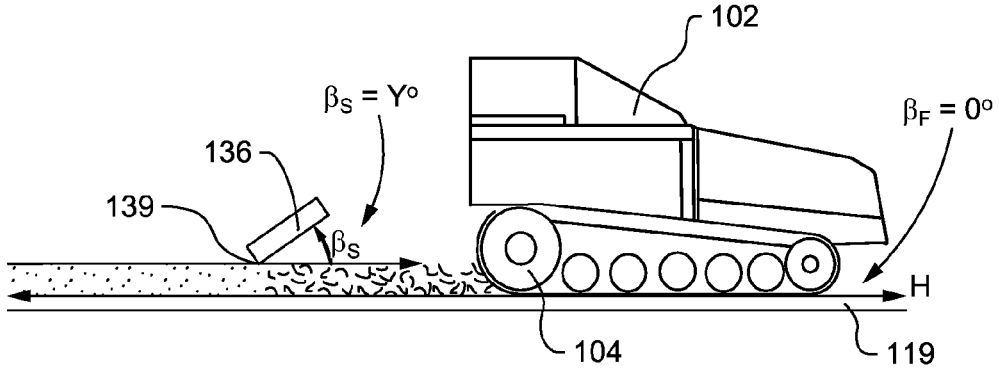

In the illustrative embodiment, the frame slope $\beta_F$ is 0° as measured by the frame inclinometer 180 and the screed slope $\beta_S$ is 0° as measured by the screed inclinometer 182. 14B is a schematic illustration of the frame slope $\beta_F$ and the screed slope $\beta_S$ at a second point in time T2. In FIG. 14B, the frame slope $\beta_F$ is 0° as measured by the frame inclinometer 180 and the screed slope $\beta_S$ is Y° (for example, 20°) as measured by the screed inclinometer 182.

Also disclosed is a method of automatically reducing transition marks 162 made by the screed assembly 118 of the paving machine 100 in the mat 120. The method may comprise while paving, determining, by the controller 174 based on data received from the sensor 172, when the inner end 148 is disposed above or below the first plane 156, and moving, by the controller 174 based on the determining, the inner end 148 to the first plane 156.

INDUSTRIAL APPLICABILITY

Figure 12:
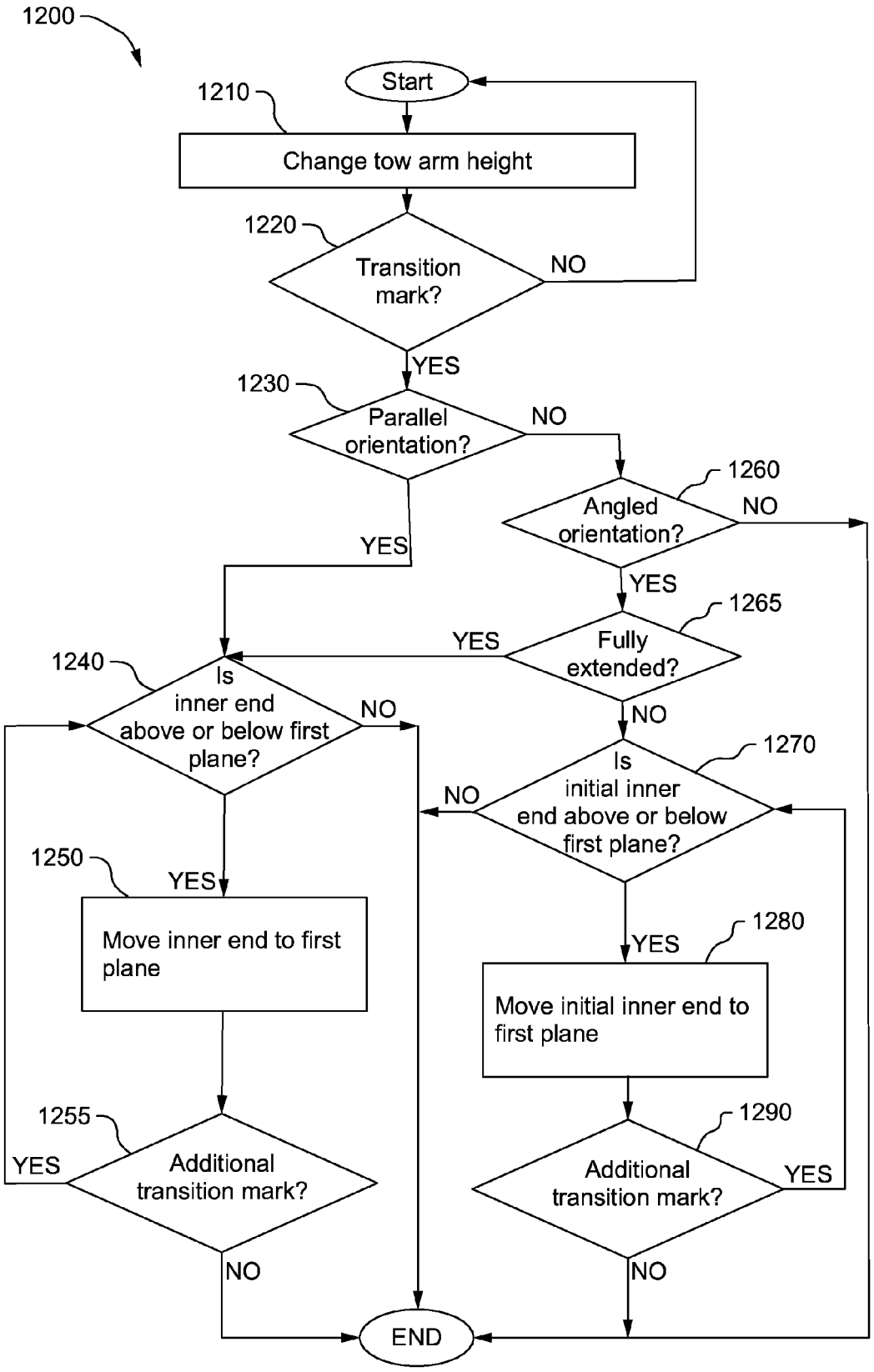
FIG. 12 is a flow chart for a method of reducing transition marks in accordance with the disclosure.

Also disclosed is an exemplary method of reducing transition marks 162 made by the screed assembly 118 of the paving machine 100 in the mat 120. Referring now to FIG. 12, the exemplary method 1200 is illustrated showing sample blocks that may be followed in the method of reducing transition marks 162 made by the screed assembly 118 of the paving machine 100 in the mat 120. The method 1200 may be practiced with more or less than the number of blocks shown.

In block 1210, based on operator input, the controller 174 increases or decreases the height of the tow arms 128 at the pivot point P in a direction perpendicular to the base 119 to be paved.

In block 1220, the controller 174 receives data from the sensors 172 indicating whether there is a change in the characteristics of the (paved) mat 120. In one embodiment, the controller 174 determines from the data that there is a transition mark 162 such as a transition ridge 164 in the mat 120 between the first and second surface sections 152, 154 of the mat 120. In another embodiment, the controller 174 may determine from the data that there is a transition waver 166 because the transverse position of the intersection 160 between the first and second surface sections 152, 154 of the mat 120 has moved (left or right).

In block 1230, the controller 174 determines whether the main screed trailing edge 139 and the extension trailing edge 146 have been configured by the operator to pave first and second surface sections 152, 154 of the mat 120 in planes that are substantially parallel to each other. In some embodiments, this information may be retrieved from memory 178 by the controller 174. If yes, the method proceeds to block 1240. If no, the method proceeds to block 1260.

In block 1240, the controller 174 determines whether the inner end 148 is disposed above or below the first plane 156. If yes, the method proceeds to block 1250.

In block 1250, the controller 174 moves the inner end 148 to the first plane 156. If the controller has previously determined in block 1230 that the main screed trailing edge 139 and the extension trailing edge 146 have been configured to pave first and second surface sections 152, 154 of the mat 120 in planes that are substantially parallel to each other, the controller 174 will move the entire extension trailing edge 146, including the inner end 148, to the first plane 156. The method then proceeds to block 1255.

In block 1255, the controller 174 receives data from the sensors 172 indicating whether there is additional change in the characteristics of the (paved) mat 120 indicative of the presence of an additional transition mark 162. If the controller 174 determines from the data that there is a transition mark 162 such as a transition ridge 164 in the 120 mat between the first and second surface sections 152, 154 of the mat 120 the method proceeds back to block 1240. In some embodiments, the controller 174 may be configured to determine over a period of elapsed time that there are no further changes in surface characteristics of the mat 120 (no further transition marks 162) before the method 1200 ends. This allows the controller 174 to maintain the extension trailing edge 146 and its inner end 148 in the first plane 156 as the elevation of the main screed plate 136 and first surface section 152 gradually changes to the increased or decreased mat thickness determined by the selected tow arm 128 position of block 1210.

In block 1260, the controller 174 determines whether the main screed plate 136 and the extension plate 144 are oriented at an angle to each other. This information may also be retrieved from memory 178 by the controller 174. If so the method proceeds to block 1265.

In block 1265, the controller 174 determines whether the extension plate 144 is fully extended. If yes, the method proceeds to block 1240. If no, the method proceeds to block 1270.

In block 1270, the controller 174 determines the position of the initial inner end 170 on the extension trailing edge 146. This information may also be retrieved from memory 178 by the controller 174. The controller 174 then determines whether the initial inner end 170 is disposed above or below the first plane 156. If yes, the method proceeds to block 1280.

In block 1280, the controller 174 moves the initial inner end 170 to the first plane 156. The method then proceeds to block 1290.

In block 1290, the controller 174 receives data from the sensors 172 indicating whether there is an additional change in the characteristics of the (paved) mat 120 (transition mark 162). If the controller 174 determines from the data that there is still a transition mark 162 such as a transition waver 166 in the mat 120 between the first and second surface sections 152, 154 of the mat 120 the method proceeds back to block 1270. In some embodiments, the controller 174 may be configured to determine over a period of elapsed time that there are no additional changes in surface characteristics of the mat 120 (transition marks 162) before the method 1200 ends. This allows the controller 174 to maintain the initial inner end 170 of the extension trailing edge 146 in the first plane 156 as the elevation of the main screed plate 136 and first surface section 152 gradually changes to the increased or decreased mat 120 thickness determined by the selected tow arm 128 position of block 1210.

Figure 13:
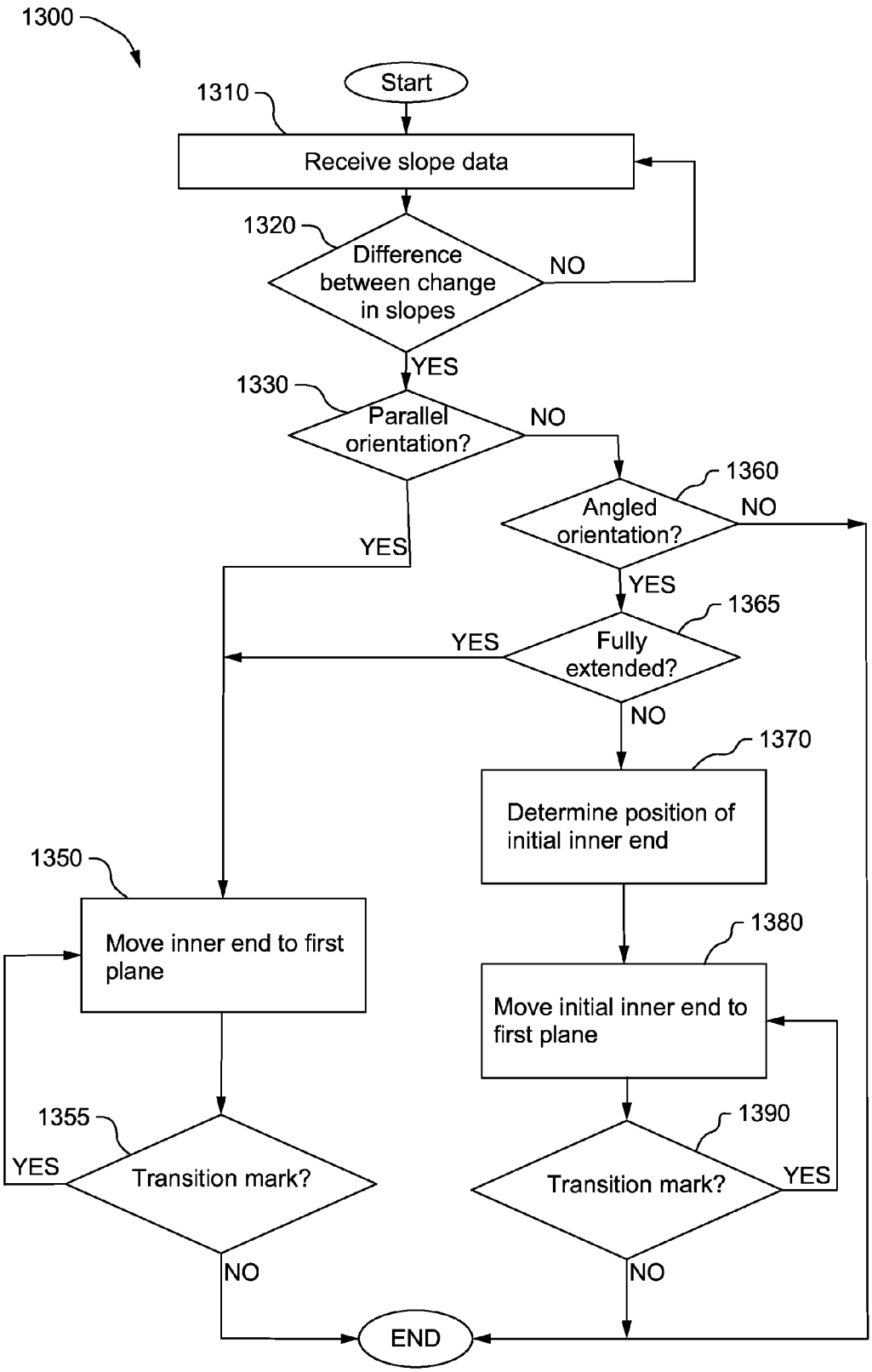
FIG. 13 is a flow chart for an alternative method of reducing transition marks in accordance with the disclosure.

Also disclosed is an exemplary alternative method of reducing transition marks 162 made by the screed assembly 118 of the paving machine 100 in the mat 120. Referring now to FIG. 13, the exemplary method 1300 is illustrated showing sample blocks that may be followed in the method of reducing transition marks 162 made by the screed assembly 118 of the paving machine 100 in the mat 120. The method 1300 may be practiced with more or less than the number of blocks shown.

In block 1310, the controller 174 receives data from the frame inclinometer 180 indicating the slope of the frame 102 at a first point in time T1 and at a second point in time T2. The controller 174 also receives data from the screed inclinometer 182 indicating the slope of the main screed plate 136 at the first point in time T1 and at the second point in time T2. Alternatively, the controller 174 may receive data from the screed inclinometer 182 indicating the slope of the main screed 132 (instead of the main screed plate 136) at the first point in time T1 and at the second point in time T2.

In block 1320, the controller calculates a frame slope change (the change in slope for the frame 102 from T1 to T2) and a screed slope change (the change in slope for the main screed plate 136 from T1 to T2). The controller 174 further determines from the data whether the change in slope for the frame 102 from T1 to T2, the frame slope change, is different than the change in slope for the main screed plate 136 from T1 to T2, the screed slope change. Alternatively, if the controller 174 in block 1310 receives data from the screed inclinometer 182 indicating the slope of the main screed 132 (instead of the main screed plate 136) at the first point in time T1 and at the second point in time T2, the controller in block 1320 may determine from the data whether the change in slope for the frame 102 (frame slope change) is different than the change in slope for the main screed 132 (screed slope change). If yes, the process proceeds to block 1330. If no, the process returns to block 1310.

In block 1330, the controller 174 determines whether the main screed trailing edge 139 and the extension trailing edge 146 have been configured by the operator to pave first and second surface sections 152, 154 of the mat 120 in planes that are substantially parallel to each other. In some embodiments, this information may be retrieved from memory 178 by the controller 174. If yes, the method proceeds to block 1350. If no, the method proceeds to block 1360.

In block 1350, the controller 174 moves the inner end 148 to the first plane 156. In one embodiment, the amount and direction of movement is determined by the difference between the change in slope for the frame 102 (from T1 to T2) as compared to the change in slope for the main screed plate 136 (from T1 to T2). In another embodiment, the amount and direction of movement is determined by the difference between the change in slope for the frame 102 (from T1 to T2) as compared to the change in slope for the main screed 132 (from T1 to T2). If the controller 174 has previously determined in block 1330 that the main screed trailing edge 139 and the extension trailing edge 146 have been configured to pave first and second surface sections 152, 154 of the mat 120 in planes that are substantially parallel to each other, the controller 174 will move the entire extension trailing edge 146, including the inner end 148, to the first plane 156. The method then proceeds to block 1355.

In block 1355, the controller 174 receives data from the sensors 172 indicating whether there is change in the characteristics of the (paved) mat 120 indicative of the presence of a transition mark 162. If the controller 174 determines from the data that there is a transition mark 162 such as a transition ridge 164 in the 120 mat between the first and second surface sections 152, 154 of the mat 120 the method returns to block 1350. This allows the controller 174, to check the accuracy of the adjustment made to the position of the inner end 148 (in block 1350). In some embodiments, the controller 174 may be configured to determine over a period of elapsed time that there are no changes in surface characteristics of the mat 120 (no transition marks 162) before the method 1300 ends.

In block 1360, the controller 174 determines whether the main screed plate 136 and the extension plate 144 are oriented at an angle to each other. This information may also be retrieved from memory 178 by the controller 174. If so the method proceeds to block 1365.

In block 1365, the controller 174 determines whether the extension plate 144 is fully extended. If yes, the method proceeds to block 1350. If no, the method proceeds to block 1370.

In block 1370, the controller 174 determines the position of the initial inner end 170 on the extension trailing edge 146. This information may also be retrieved from memory 178 by the controller 174.

In block 1380, the controller 174 moves the initial inner end 170 to the first plane 156. The method then proceeds to block 1390.

In block 1390, the controller 174 receives data from the sensors 172 indicating whether there is a change in the characteristics of the (paved) mat 120 (transition mark 162). If the controller 174 determines from the data that there is a transition mark 162 such as a transition waver 166 in the mat 120 between the first and second surface sections 152, 154 of the mat 120 the method proceeds to block 1380. This allows the controller 174, to check the accuracy of the adjustment made to the position of the initial inner end 170 (in block 1380). In some embodiments, the controller 174 may be configured to determine over a period of elapsed time that there are no additional changes in surface characteristics of the mat 120 (transition marks 162) before the method 1300 ends.

The features disclosed herein may be particularly beneficial to paving machines 100. Use of the features enables reduction in transition marks 162, for example, transition ridges 164 or transition waver 166, so that the mat 120 laid down by the paving machine 100 has an even surface from start to finish and does not have ridges or steps or lanes of uneven width.

What is claimed is:

1. A paving machine for paving a mat on a base, the mat having a first surface section contained in a first plane and a second surface section contained in a second plane, the second surface section being adjacent to the first surface section, the paving machine comprising:

a frame;

a tow arm connected to the frame and pivotable about a pivot point;

a screed assembly connected to the frame by the tow arm, the screed assembly including a main screed plate and an extension plate, the main screed plate configured to pave the first surface section of the mat, the extension plate including an extension trailing edge having an inner end, the extension plate being configured to pave the second surface section of the mat; and a sensor mounted on the screed assembly and configured to sense transition marks in the mat at an intersection between the first and second surface sections and further configured to transmit data indicative of the transition marks to a controller, the controller being configured to, while the paving machine is paving:

determine from the data received from the sensor when the inner end is disposed above or below the first plane, and move the inner end to the first plane, wherein the transition marks are defined by at least one of discontinuities in mat thickness at the intersection between the first surface section and the second surface section, and transverse shifts in a position of the intersection between the first surface section and the second surface section.

2. The paving machine of claim 1, wherein the first surface section is disposed behind the main screed plate relative to a direction of travel of the paving machine, and the second surface section is disposed behind the extension plate relative to the direction of travel of the paving machine.

3. The paving machine of claim 1, wherein the first plane is substantially parallel to the second plane.

4. The paving machine of claim 3, wherein, when the controller moves the inner end of the extension trailing edge to the first plane, an entirety of the extension trailing edge is moved by the controller to the first plane.

5. The paving machine of claim 4, in which the controller is further configured to maintain the extension trailing edge in the first plane as the paving machine moves forward.

6. The paving machine of claim 1, wherein the second plane is disposed at an angle to the first plane.

7. The paving machine of claim 6, wherein the inner end is an initial inner end.

8. The paving machine of claim 1, in which the controller is further configured to change in a first direction a position of the tow arm at the pivot point, the first direction being perpendicular to the base.

9. A method for automatically reducing transition marks made by a screed assembly of a paving machine in a mat while paving the mat over a base, the mat having a first surface section contained in a first plane and a second surface section contained in a second plane, the second surface section being adjacent to the first surface section, the paving machine including a frame, a tow arm connected to the frame and pivotable about a pivot point, the screed assembly being connected to the frame by the tow arm, a sensor mounted on the screed assembly, and a controller, the screed assembly including a main screed plate and an extension plate, the main screed plate being configured to pave the first surface section of the mat, the extension plate including an extension trailing edge having an inner end, the extension plate being configured to pave the second surface section of the mat, the sensor being configured to sense transition marks in the mat at an intersection between the first and second surface sections and to transmit data indicative of the transition marks to the controller, the method comprising:

while paving, determining, by the controller based on data received from the sensor, when the inner end is disposed above or below the first plane; and moving, by the controller based on the determining, the inner end to the first plane, wherein the transition marks are defined by at least one of discontinuities in mat thickness at the intersection between the first surface section and the second surface section, and transverse shifts in a position of the intersection between the first surface section and the second surface section.

10. The method of claim 9, wherein the first surface section is behind the main screed plate relative to a direction of travel of the paving machine and the second surface section is behind the extension plate relative to the direction of travel of the paving machine.

11. The method of claim 9, wherein the first plane is substantially parallel to the second plane.

12. The method of claim 11, in which the moving includes, moving an entirety of the extension trailing edge to the first plane.

13. The method of claim 9, further including, maintaining, by the controller, the inner end in the first plane as the paving machine moves forward.

14. The method of claim 9 further including, wherein the second surface section is disposed at an angle to the first surface section.

15. The method of claim 14, wherein the inner end is an initial inner end.

16. The method of claim 9, further including changing, in a first direction, a position of the tow arm at the pivot point, the first direction being perpendicular to the base.

17. A paving machine for paving a mat on a base, the mat having a first surface section contained in a first plane and a second surface section contained in a second plane, the second surface section being adjacent to the first surface section, the paving machine comprising:

a frame;

a tow arm connected to the frame and pivotable about a pivot point;

a screed assembly connected to the frame by the tow arm, the screed assembly including a main screed plate and an extension plate, the main screed plate being configured to pave the first surface section of the mat, the extension plate including an extension trailing edge having an initial inner end, the extension plate being configured to pave the second surface section of the mat;

a plurality of sensors mounted on the screed assembly and configured to sense transition marks in the mat at an intersection between the first and second surface sections, and further being configured to transmit data indicative of the transition marks to a controller;

a frame inclinometer mounted on the frame and configured to measure a frame slope in relation to a horizontal plane at a first point in time and a second point in time; and a screed inclinometer mounted on the screed assembly and configured to measure a screed slope of the main screed plate in relation to the horizontal plane at the first point in time and the second point in time, the controller being operatively coupled to the frame inclinometer and the screed inclinometer, the controller being configured to, while the paving machine is paving:

calculate a frame slope change based on a signal from the frame inclinometer and a screed slope change based on a signal from the screed inclinometer, determine whether the frame slope change is different from the screed slope change, when the first plane and the second plane are parallel and the frame slope change is different from the screed slope change, move the extension trailing edge to the first plane, and when the second plane is disposed at an angle to the first plane and the frame slope change is different from the screed slope change, move the initial inner end to the first plane, wherein the transition marks are defined by at least one of discontinuities in mat thickness at the intersection between the first surface section and the second surface section, and transverse shifts in a position of the intersection between the first surface section and the second surface section.

18. The paving machine of claim 17, wherein the first surface section is behind the main screed plate and the second surface section is behind the extension plate.

19. The paving machine of claim 17, in which the controller is further configured to, when the first plane and the second plane are parallel, maintain the extension trailing edge in the first plane as the paving machine moves forward.

20. The paving machine of claim 17, in which the controller is further configured to, when the second plane is disposed at an angle to the first plane, maintain the initial inner end in the first plane as the paving machine moves forward.

* * * * *